US005188182A

United States Patent [19]

Echols, III et al.

[11] Patent Number: 5,188,182

[45] Date of Patent: Feb. 23, 1993

[54] SYSTEM CONTAINING EXPENDIBLE ISOLATION VALVE WITH FRANGIBLE SEALING MEMBER, SEAT ARRANGEMENT AND METHOD FOR USE

[75] Inventors: Ralph H. Echols, III, Carrollton; Joseph L. Pearce, Dallas, both of Tex.; Daniel L. Patterson, Brunei Darussalam, Malaysia

[73] Assignee: Otis Engineering Corporation, Dallas, Tex.

[21] Appl. No.: 698,449

[22] Filed: May 10, 1991

Related U.S. Application Data

[63] Continuation-in-part of Ser. No. 552,109, Jul. 13, 1990, abandoned.

[51] Int. Cl.[5] ..... E21B 43/04; E21B 34/06

[52] U.S. Cl. ..... 166/376; 166/51; 166/325

[58] Field of Search ..... 166/51, 376, 317, 325; 251/368

[56] References Cited

U.S. PATENT DOCUMENTS

| | | | |
|---|---|---|---|
| 4,154,303 | 5/1979 | Fournier | 166/317 |
| 4,160,484 | 7/1979 | Watkins | 166/323 |
| 4,378,847 | 4/1983 | Patel et al. | 166/317 |
| 4,423,773 | 1/1984 | Stout | 166/51 |
| 4,433,702 | 2/1984 | Baker | 137/527.6 |
| 4,541,484 | 9/1985 | Salerni et al. | 166/228 |
| 4,597,445 | 7/1986 | Knox | 166/319 |
| 4,691,775 | 9/1987 | Lustig | 166/317 |
| 4,716,968 | 1/1988 | Pringle | 166/319 |
| 4,813,481 | 3/1989 | Sproul et al. | 166/51 |

FOREIGN PATENT DOCUMENTS

| | | |
|---|---|---|
| L03L139 | 5/1966 | United Kingdom . |
| 2183695 | 6/1987 | United Kingdom . |
| 2188962 | 10/1987 | United Kingdom . |
| 2112041 | 7/1988 | United Kingdom . |

*Primary Examiner*—William P. Neuder
*Attorney, Agent, or Firm*—Thomas V. Malorzo

[57] ABSTRACT

An isolation valve for a downhole well completion system having a one piece frangible, ceramic sealing element and an extrusion resistant resiliently faced valve seat and a method for the use thereof is presented. Said sealing element is biased to the closed position and rotatable within a sealing element chamber from an open position during run in to a closed position as a result of the withdrawal of a wash pipe and a protector tube from the valve bore. Said frangible sealing element cooperates with said extrusion resistant valve seat to provide a reliable pressure resistant seal. After recovery of completion fluids from the well bore and pressure testing of the production string, the frangible sealing element is shattered by impacting with a tooth-faced blind box hammer.

29 Claims, 8 Drawing Sheets

SYSTEM CONTAINING EXPENDIBLE ISOLATION VALVE WITH FRANGIBLE SEALING MEMBER, SEAT ARRANGEMENT AND METHOD FOR USE

This is a continuation-in-part of our copending U.S. patent application Ser. No. 07/522,109, filed on Jul. 13, 1990, now abandoned.

FIELD OF THE INVENTION

The invention relates generally to apparatus for completing downhole wells and in particular to an isolation valve which may be inserted in the casing or liner of a subterranean well for purposes of both pressure testing said casing or liner and preserving well completion fluids from loss to the producing formation.

BACKGROUND OF THE INVENTION

In the course of completing and maintaining subterranean wells, a number of operations are performed which require the introduction of fluids, generally termed completion fluids, into the well bore and into the producing formation. One of the common completion techniques performed on a well prior to placing it into production is gravel packing in which a slurry containing gravel is injected into the well to provide an in situ filtration medium to remove sand fines from produced fluids.

Subsequent to the gravel packing operation, a fluid such as water is introduced into the well to flush out excess gravel from the work string which is suspended within the bore of the production tubing. After the excess gravel slurry is flushed from the production tubing and the work string, the production tubing and the work string are filled with more dense completion fluids to prevent loss of produced fluids when the work string is withdrawn from the well prior to commencing production. After the well has been flushed with water and then filled with completion fluids as aforesaid, the work string, typically consisting of a service seal unit (cross-over tool), a sleeve valve shifter, and a wash pipe are withdrawn from the well bore leaving production packers, the closed sleeve valve and sand screens in place as functional parts of the production equipment.

Typically, the removed work string and its associated components contain large quantities of completion fluids which drain from the component tools into the annulus between the well casing and the work string as they are withdrawn from the well.

Because completion fluids are expensive and also possibly damaging to the producing formation, it is desirable to prevent the loss of completion fluids into the producing formation. It is also desirable to pressure test the tubing string to insure against the presence of leaks in the production tubing string prior to commencing production.

Typically, the processes of prevention of loss of completion fluids and of pressure testing the tubing is accomplished by the inclusion of an isolation valve with a frangible sealing member which is run in the hole as a part of the production tubing.

Conventional frangible isolation valves typically have frangible sealing elements made of glass or metal and are equipped either with an elastomeric hinge means which is bonded directly to said glass or metal sealing element such as in U.S. Pat. No. 4,813,481, or with retaining rings, springs or clips such as is disclosed in U.S. Pat. No. 4,216,830, into which said glass or metal sealing element is mounted said rings, springs or clips also functioning as hinge means. Such conventional frangible sealing elements are subject to abrasion, pitting and scarring which impairs sealing ability, and, after the sealing element has been broken, said hinge means remain down hole and frequently at least partially obstructs the well bore thereby increasing the difficulty with which subsequent down hole operations may be conducted.

In addition to the above difficulties which are associated with conventional frangible sealing elements, such valves also typically employ a resilient tapered sealing member in the valve seat such as that disclosed in U.S. Pat. No. 4,813,481. However, such resilient tapered valve seats in combination with the frangible sealing element often do not provide a reliable seal at the high pressures which are applied to the tubing during a pressure test thereof because the resilient sealing member tends to extrude into the bore of said valve seat.

Other U.S. patents which disclose isolation valves of the same general type as that disclosed in this Specification include U.S. Pat. Nos. 4,154,303; 4,160,484; 4,423,773; 4,433,702; 4,541,484; 4,597,445; 4,691,775.

OBJECTS OF THE INVENTION

A principle object of the invention is to provide an improved isolation valve having a sealing element made of a frangible material which, in response to mechanical impact of a tool, will break into pieces small enough to be circulated out of the well by fluid pressure.

Another related object of the invention is to provide a isolation valve with an improved frangible sealing element which has a frangible hinge member as an integral part of said sealing element.

A still further object of the invention is to provide a sealing element which is resistant to abrasion, pitting and scarring.

Another principle object of the invention is to provide a resilient valve seat which cooperates with a sealing element to provide at once a reliable seal at low pressure and a pressure resistant seal at higher pressures.

A further object of the invention is to provide a valve seat assembly in which the resilient sealing member is resistant to extrusion into the well bore.

A further related object of the invention is to provide an improved isolation valve assembly which is automatically closable upon withdrawal of a wash pipe or protector tube therefrom, and having a machinable, frangible, sealing element which produces a reliable seal when closed.

Still another object of the invention is to provide a frangible isolation valve assembly which will operate independently of the need for a packer and its associated wash pipe to be run into the hole concurrently with said isolation valve assembly.

SUMMARY OF THE INVENTION

The foregoing objects are accomplished by an isolation valve which provides a one piece rotatable sealing element and a grooved resilient valve seat assembly both of which are mounted in a tubular valve housing which is, in turn, located in the production tubing of a well at a position above a producing formation.

In the preferred embodiment, a frangible sealing element, which is comprised of a machinable frangible material, preferably ceramic, is biased to the closed position by a spring mounted about the hinge means thereof and is restrained in the open position by a protector tube which is shearably mounted in the valve body. Said protector tube, which functions to protect said sealing element from damage during run in and during tubing manipulations, has a no-go shoulder located within its bore. Said protector tube is removed from said valve bore when a no-go locator, which is made up as a part of the work string which is positioned within the bore of said protector tube on run in is pulled into contacting engagement with said no-go shoulder so that upward tension exerted against said no go shoulder separates the shearable mounting means thereby allowing said protector tube to be removed from said valve bore and said sealing element to rotate to the closed position as aforesaid. The groove in said grooved valve seat assembly functions to prevent the resilient valve seat member from extruding into the valve bore as pressure is applied to the closed rotatable flapper thereby providing a reliable pressure resistant seal.

In an alternative embodiment, said sealing element of said isolation valve is restrained in the open position when it is introduced into the well bore by a wash pipe which extends from a packer mounted within the production string above said valve body and through the bore of said valve body. The wash pipe also functions to protect said sealing element from damage while the valve is being run in the hole. The sealing element is rotated to the closed position by the force exerted by said hinge spring when the wash pipe is pulled from the bore of said valve body as the work string is withdrawn from the hole.

The frangible sealing element, when in the closed position, both prevents the back flow of completion fluids into the formation and acts in sealing engagement with the valve seat to provide a closed system for pressure testing the tubing string above the completion tools. Said frangible sealing element is disposed for shattering when in the closed position by striking said frangible sealing element with a tooth-faced blind box hammer.

The novel features of the invention are set forth with particularity in the claims. The invention will be best understood from the following description when read in conjunction with the accompanying drawings.

DETAILED DESCRIPTION OF THE PREFERRED EMBODIMENT

Figure 1A:
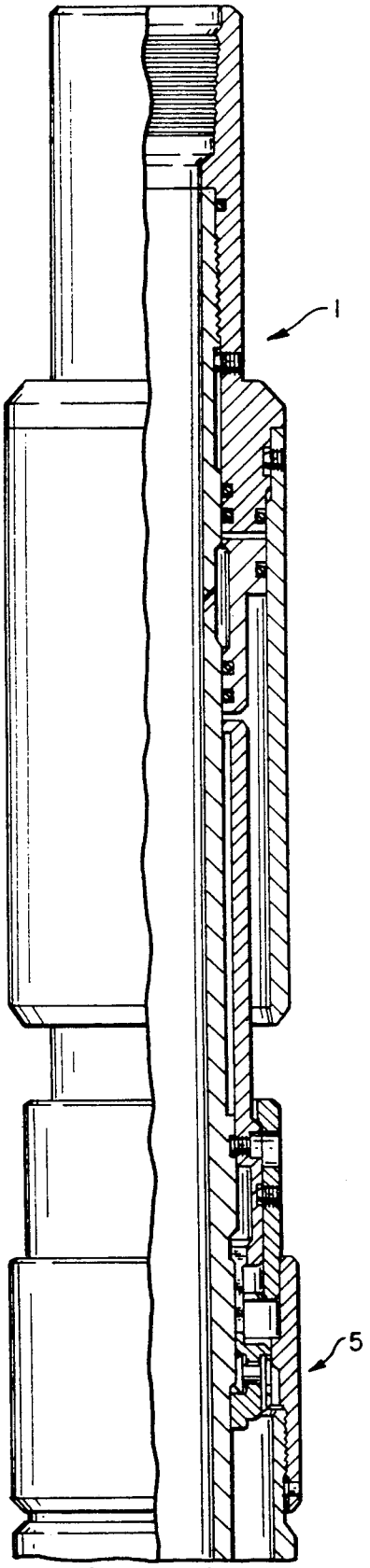
FIG. 1 A through J is a view, partly in section and partially in elevation, showing a typical well installation using an isolation valve assembly constructed according to the present invention.
Figure 1B:
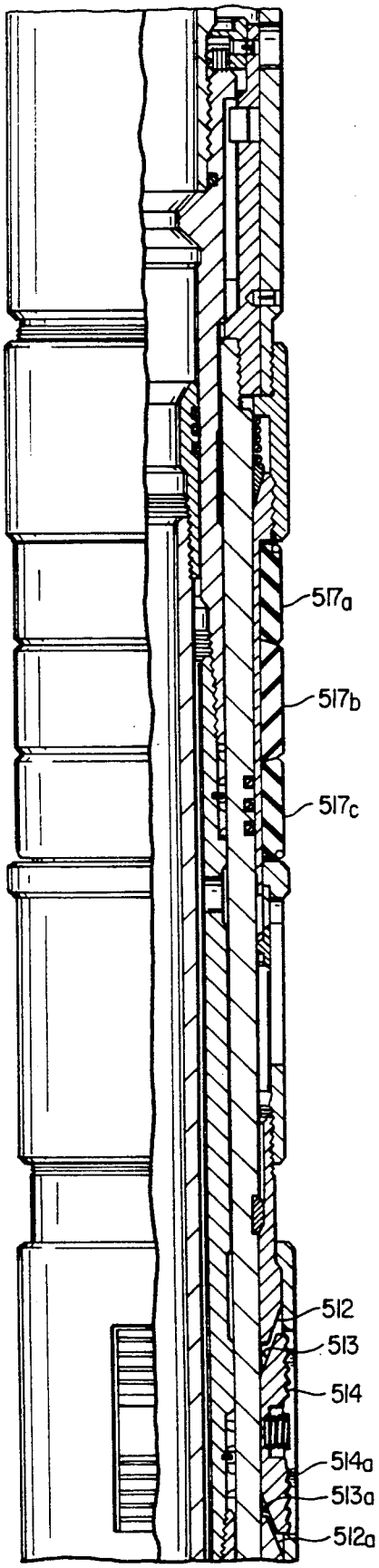
Figure 1C:
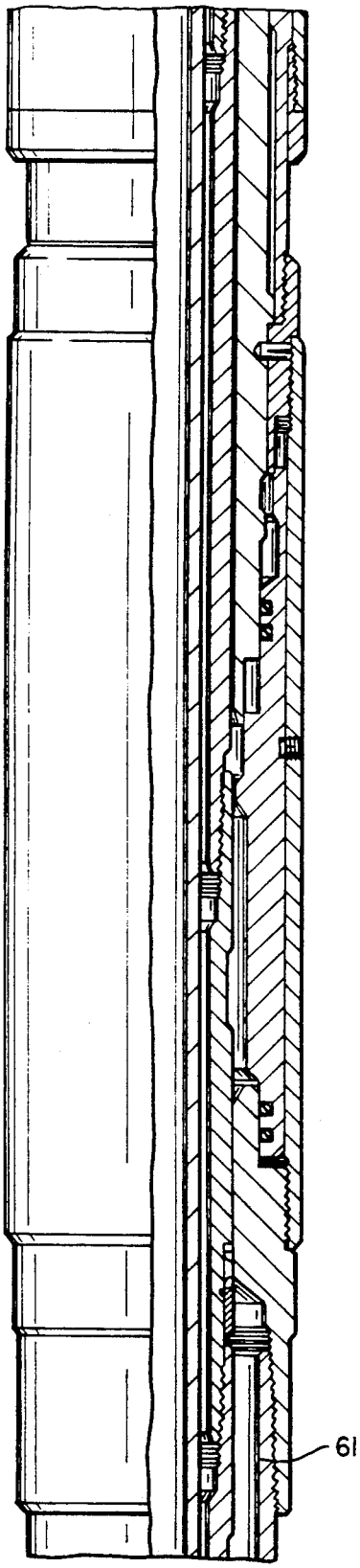
Figure 1D:
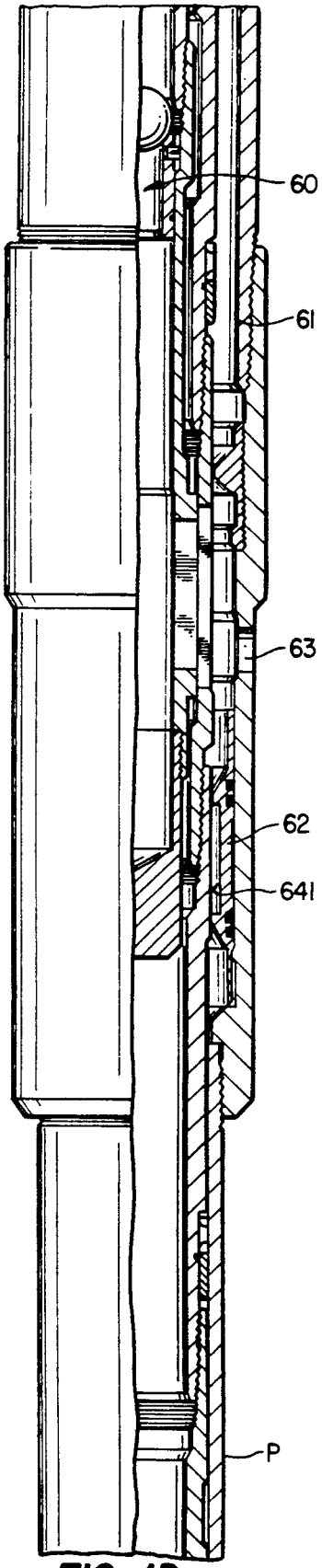
Figure 1E:
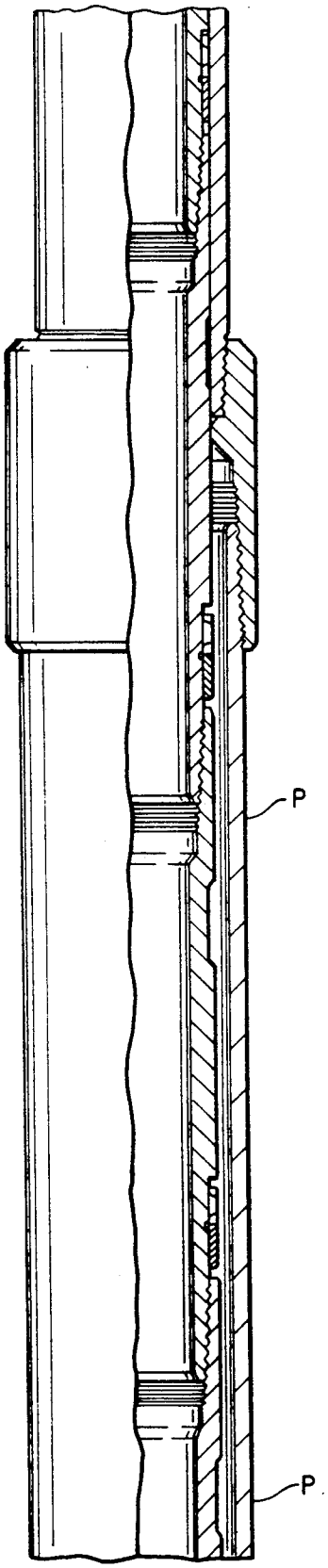
Figure 1F:
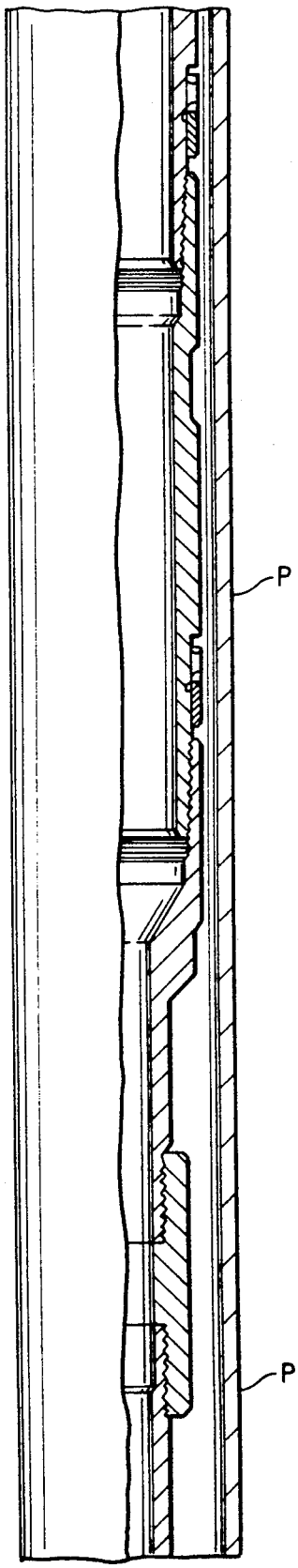
Figure 1G:
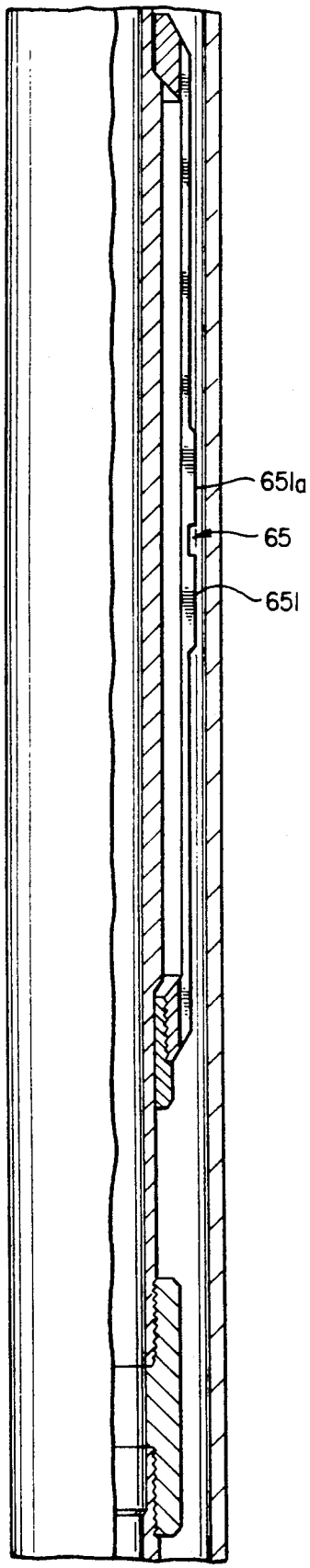
Figure 1H:
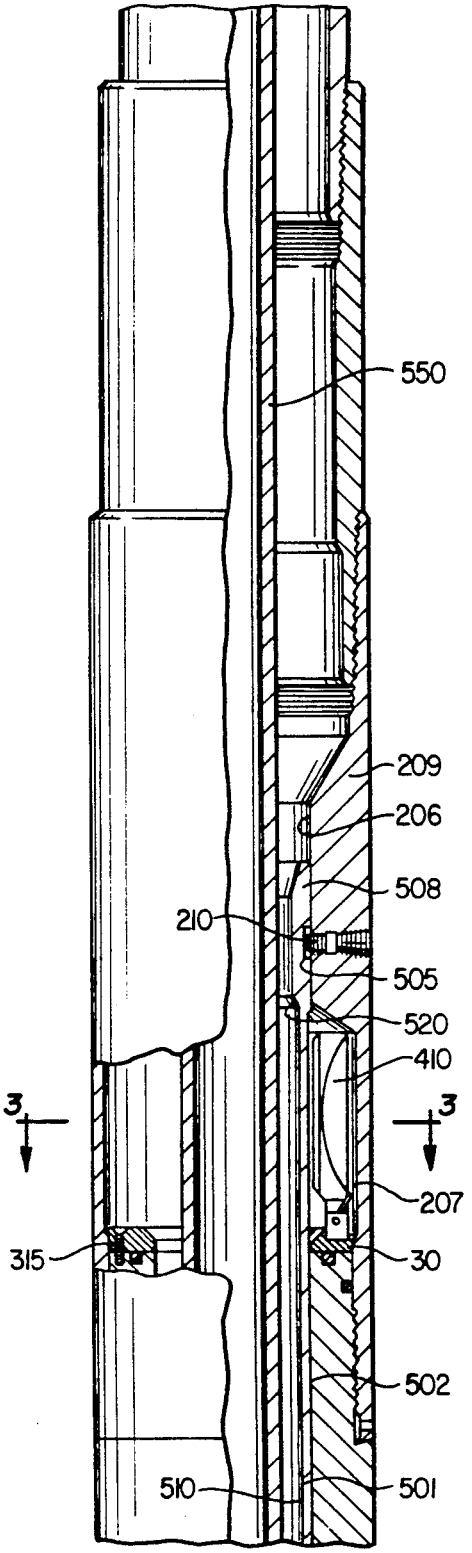
Figure 1I:
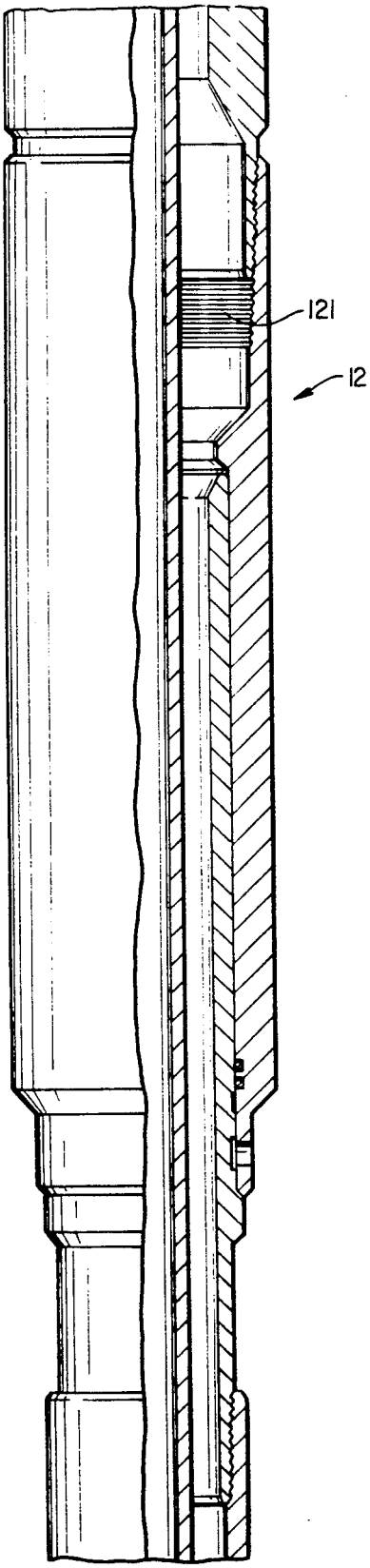
Figure 1J:
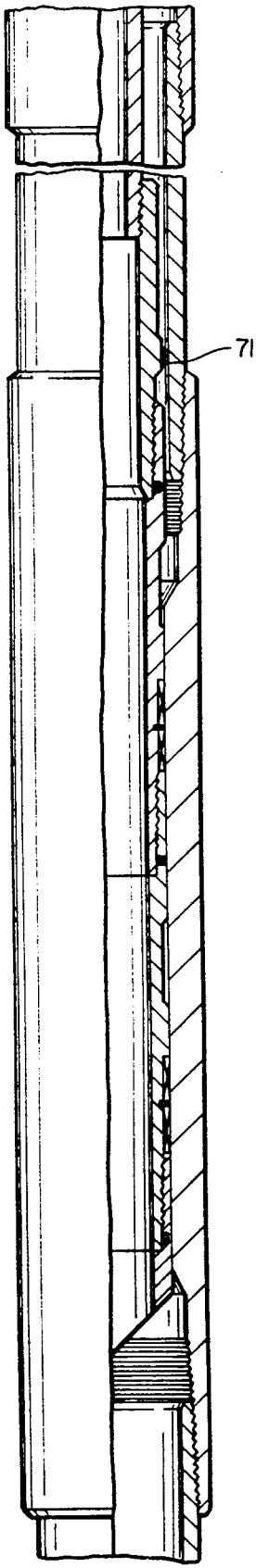

In the description that follows, like parts are marked throughout the specification and drawings with the same reference numerals, respectively. The drawings are not necessarily to scale and the proportions of certain parts have been exaggerated to better illustrate the details of the present invention.

Referring to FIG. 1 A through J, in the preferred embodiment of this invention, a packer 5 of the type disclosed in U.S. Pat. No. 4,834,175, or any similar packer, a sleeve valve assembly having a plurality of flow ports 63 therethrough comprising closing sleeve 61, and shifting sleeve 62 with detent 641 cut into its inner wall, valve assembly 20 and shear sub 12 are threadably connected to each other as part of the production tubing string 1. Below said shear sub, said production tubing string may also have threadedly included therein such tools as well screens, tell—tale screens and the like, with the lowermost of said tools in the string being stabbed into a sump packer, not shown, which is positioned below the lowermost producing formation in the well bore, all of said tools being well known in the art. Made up within the bore 11 of said production tubing string and run in the hole concurrently therewith is a work string comprising wash pipe 515 which extends below said packer and is threadedly connected to a service seal unit 60, otherwise known as a crossover tool, of the type disclosed in U.S. Pat. No. 4,832,129, or any similar device, said service seal unit having shifting collet 65 with raised finger portions 651, 651*a*, several lengths of blank pipe, P, and no-go locator 71 threadedly interconnected with each other. Other examples of typical assemblages of gravel pack equipment are described and illustrated in brochure number OEC—5545 entitled "Otis Sand Control Multi-Position Gravel Pack System", copyright 1990, published by Otis Engineering Corporation, Carrollton, Tex. Additional tools which may be desired or necessary to place the well in condition for production all of which are well known in the art, can also be included in either said production tubing string or in said work string. The aforesaid patents and reference are incorporated herein for all purposes.

Figure 2:
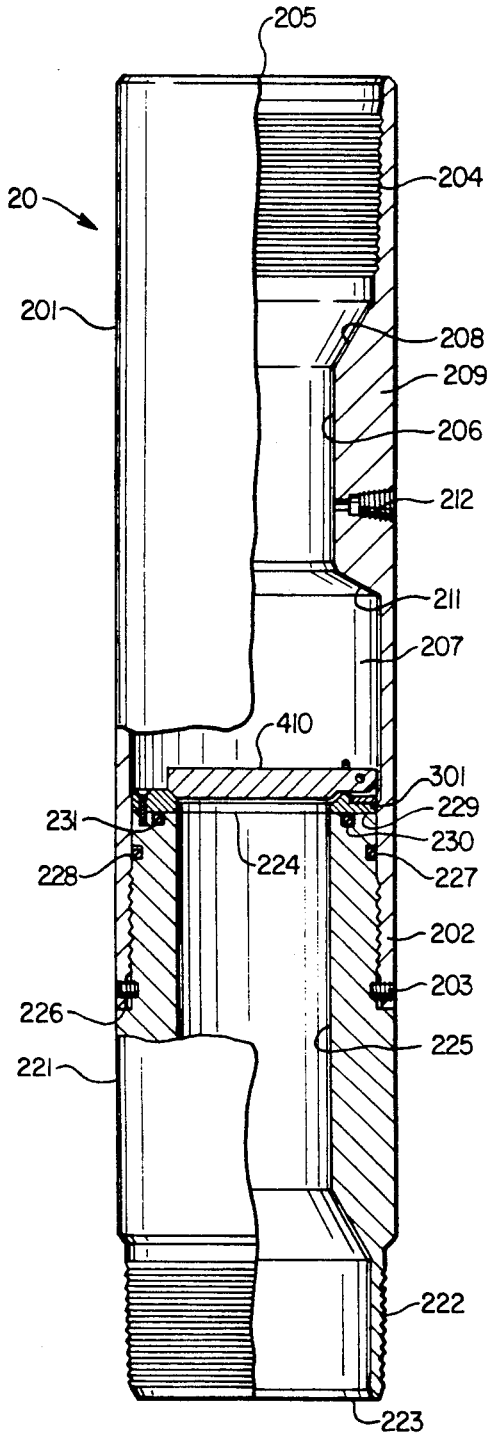
FIG. 2 is a view, partly in section and partly in elevation, showing the isolation valve with the sealing element in the closed position after removal of the protector tube.
Figure 3:
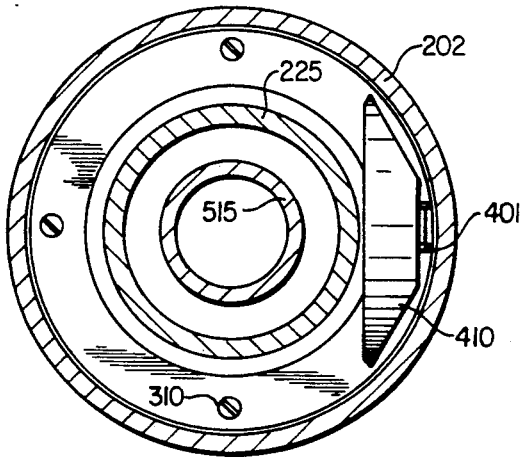
FIG. 3 is a cross section of the isolation valve taken along lines 3—3 with the sealing element in the fully open position.

Referring now to FIG. 2, isolation valve assembly 20 consists of an upper housing 201 and a lower housing 221. The lower end of said lower housing is fitted with a threaded pin connector 222 and has a first opening 223 and a second opening 224, said first opening and said second opening being connected by fluid bore 225. A portion of the outer circumference of said lower housing forms an externally threaded radially inwardly stepped shoulder 226 over which sleeve portion 202 of the upper housing is threadedly fitted in sealing engagement with said lower housing and secured against rotation with reference to said lower housing by multiple set screws 203 which pass through said sleeve portion of said upper housing into a corresponding groove milled into the exterior of said stepped shoulder portion of said lower housing.

Said lower housing has groove 227 machined into its outer surface said groove passing around its circumference and operating to confine sealing means 228. The bore 225 of said lower housing is of smaller internal diameter than the internal diameter of pin connector 222 forming shoulder 229 at the upper end of said lower housing.

Upper shoulder 229 has a radial groove 230 circumscribing its surface which accommodates sealing means 231. Sealing means 231 cooperates with valve seat assembly 30 to prevent leakage of fluid around the surfaces of said valve seat assembly.

Upper housing 201 is fitted at its upper end with threaded box connector 204 and has an opening 205 in said box connector connected by fluid bore 206 to sealing element chamber 207. The inner end of said box connector has an upper radially inwardly stepped shoulder 208 which reduces the diameter of fluid bore 206 and increases the thickness of upper housing sidewall 209 functions to provide support for shear screws 210 which are located intermediate said upper radially stepped shoulder 208 and a lower outwardly radially stepped shoulder 211 to support protector tube 501 shown in FIG. 1H, the structure of said protector tube being discussed below. The reduced diameter of bore 206 in the upper housing is similar in diameter to that of bore 225 in the said lower housing. Lower outwardly radially stepped shoulder 211 located intermediate shear screws 210 and said upper shoulder 229 of said lower housing increases the diameter of bore 206 thus forming sealing element chamber 207. Sealing element chamber 207 located intermediate said lower outwardly stepped shoulder 211 and valve seat member 301 is of sufficient internal radius and length to accommodate the length and thickness of flapper means 410 remotely from said valve bore when said sealing element is in its open position.

Valve seat assembly 30 comprises a non-elastomeric valve seat 301 which cooperates with resilient seal means 302 to form an extrusion resistant valve seat which receives frangible flapper means 410 in sealing engagement therewith.

Valve seat 301 is a cylindrical member having flow bore 303 extending therethrough to which is bonded resilient seal means 302 as described below.

Annular groove 306 is cut into said valve seat adjacent said flow bore thereby forming support shoulder 307 intermediate said annular groove and said flow bore.

Resilient seal means 302 is preferably formed from a reinforced polymer such as a glass—filled fluorocarbon, preferably a glass—filled teflon compound will remain flexible under downhole conditions. Said resilient elastomeric material may also comprise an elastomeric polymer such as nitrile rubber. Of course, one skilled in the art will readily recognize that any resilient material which will remain flexible under downhole conditions could be substituted for those specified.

Figure 4A:
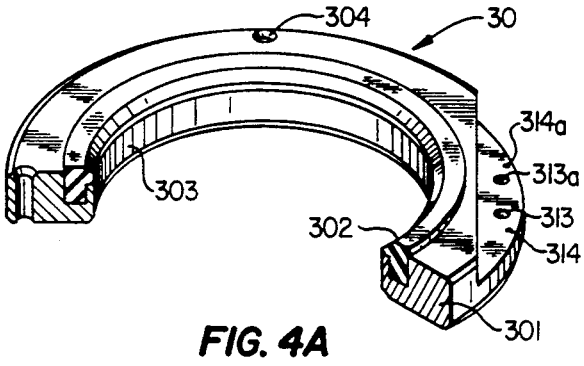
FIG. 4A is an view, in perspective of the valve seat assembly.
Figure 4B:
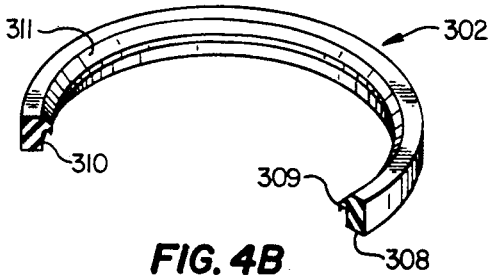
FIG. 4B is a view, in perspective of the resilient seal means which comprises in part the valve seat assembly
Figure 4C:
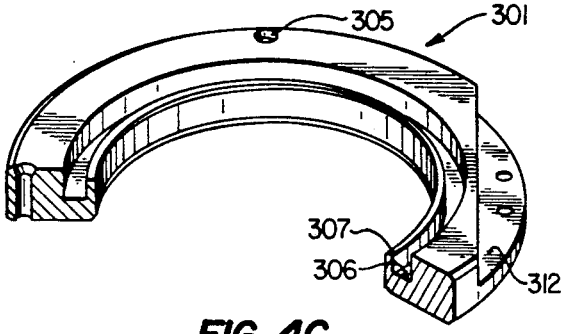
FIG. 4C is a view, in perspective of the valve seat which comprises in part the valve seat assembly
Figure 5:
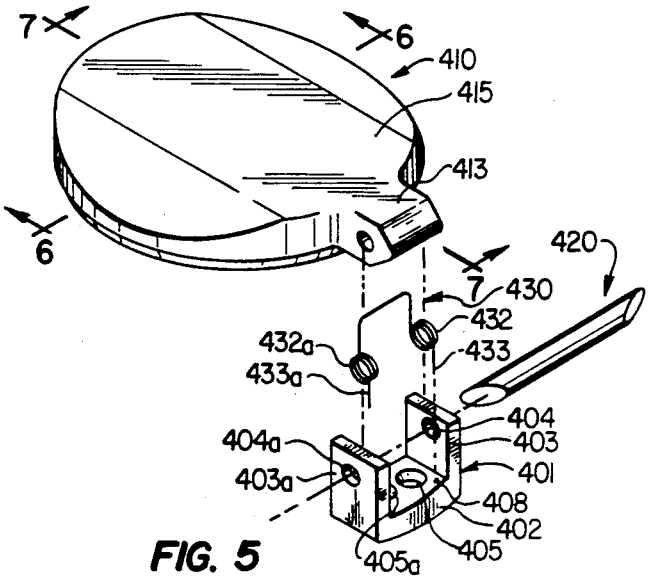
FIG. 5 is an exploded perspective view of the seal assembly.
Figure 6:
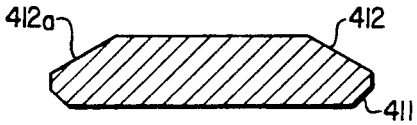
FIG. 6 is a cross sectional view of the frangible sealing element taken along lines 6—6.
Figure 7:
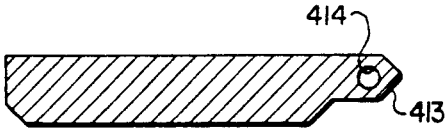
FIG. 7 is a cross sectional view of the frangible sealing element taken along lines 7—7.

Referring now to FIG. 4B, said resilient seal means has a lower mating surface 308 which is shaped to fit tightly in annular groove 306 and a hook-like inner support shoulder 309 which forms shoulder mating groove 310 intermediate said inner support shoulder and said lower mating surface.

As shown in FIG. 4A, rectangular lower mating surface 308 is landed in groove 306 with hook-like inner support shoulder 309 mated to and cooperating with support shoulder 307 to prevent the resilient seal means from being extruded into flow bore 303 as pressure is exerted thereon by flapper means 410 and by fluids which exert pressure on said flapper when said flapper is in the closed position. Said resilient seal is bonded in place in said valve seat using an appropriate cementing medium such as epoxy cement, which is well known in the art.

Prevention of such extrusion improves the quality of sealing engagement between said flapper and said valve seat. Laboratory tests of the valve seat assembly with the flapper means have indicated a positive seal with no leakage at an applied force of 10,000 psi.

The upper surface of resilient seal has a radially inwardly sloping shoulder 311 which forms a sealing surface in cooperation with corresponding sealing surface 411 of flapper means 410.

Valve seat member 301 also has a plurality of parallel bores 304 therethrough, each said bore being substantially parallel to valve bore 302 and being disposed to receive attaching means 315 to fixedly and sealingly attach said valve seat member to upper shoulder 229. Each of said plurality of parallel bores has an outwardly radially sloping shoulder 306 at its upper end to accommodate said attaching means in countersunk fashion to minimize intrusion of said attaching means into sealing element chamber 207. When said valve seat member is securely attached to said upper shoulder, sealing means 231 is compressed between the lower side of said valve seat and said upper shoulder to form a fluid—tight seal therebetween.

Valve seat 301 has a stepped shoulder 312 cut into its upper surface to serve as a mounting plate for the horizontal portion 402 of hinge bracket 401, described below. Said mounting plate also has a plurality of hinge bracket mounting bores 313, **313*a* and spring stud retaining holes 314, 314*a* which restrain closing spring 430** in position as described below.

Sealing element 410 comprising a machinable, frangible ceramic material has sufficient strength to withstand required pressures and will shatter into small pieces when impacted by toothed faced blind box hammer 801, described below. Sealing surface 411 which slopes radially inwardly from the outermost edge of said sealing element on its lower side forms a generally spherical seat arrangement when in contact with elastomeric valve seat 305 of valve seat member 301. The upper side of said sealing element has two diametrically opposed radially upwardly sloping shoulders 412, **412*a* which cooperate with each other to form a thickened center section 415 of said sealing element which is appreciably thicker than the outer edge of said sealing element and approximately the same thickness as hinge means 413. Hinge means 413, located adjacent said center section 415 is an integrally molded part of said sealing element also comprising machinable, frangible ceramic material. Said hinge means has hinge pin bore 414 therethrough, said hinge pin bore being in substantially the same plane as the plane of seating surface 411. Sealing element 410 is fixedly attached to upper shoulder 229 by means of hinge bracket 401**.

Hinge bracket 401 is preferably formed from a single piece of rigid material, such as steel or the like and has a substantially rectangular horizontal portion 402 and two vertical portions 403 , **403*a* of approximately the same length rising in the same direction from opposite ends of said rectangular portion 402. Each vertical portion has a hinge pin bore 404, 404***a* therethrough, each bore being of sufficient diameter to accommodate insertion of hinge pin 420 and being positioned sufficiently remote from said horizontal portion to allow hinge portion 413 to rotate freely within the interior space bounded by the two said vertical portions and said horizontal portion.

Hinge bracket 401 is fixedly attached to valve seat 301 by a plurality of attachment means, each one of said plurality of attachment means passing through one of said plurality of bores through the horizontal portion of said hinge bracket and through a corresponding bore in valve seat 301 into upper shoulder 229. A plurality of fastener bores through said hinge bracket is necessary to fixedly align said sealing means over bore 225 of lower valve section 221 in such manner as to both maximize the sealing capabilities of the valve when said sealing means is in the closed position and align the valve seat assembly so the bore thereof is concentric with valve bore 225.

Sealing means 410 is rotatably attached to hinge bracket 401 by hinge pin 420 which passes first through bore 404 in the first of said vertical portions of said hinge bracket, thence through hinge pin bore 414 in said sealing means and finally through the bore 404*a* of the second of said vertical portions of said hinge means. In this manner, said sealing means, which is biased to the closed position by spring 430, described below, is free to rotate about the axis formed by hinge pin 420 and hinge pin bores 404 and 404*a* within the boundary formed by the inner surface of said sealing element chamber and the upper surface of said valve seat assembly.

Spring 430 is formed from a wire which first passes over hinge means 413, is then formed into coils 432, 432*a* which are located intermediate the interior edge of said vertical portions of said hinge bracket and confined in place by said hinge pin passing therethrough, and terminating in wire studs 433, 433*a* which are inserted through drill holes 408, only one of which is shown, and into spring stud retaining holes 314, 314*a* in valve seat assembly 301.

Figure 10A:
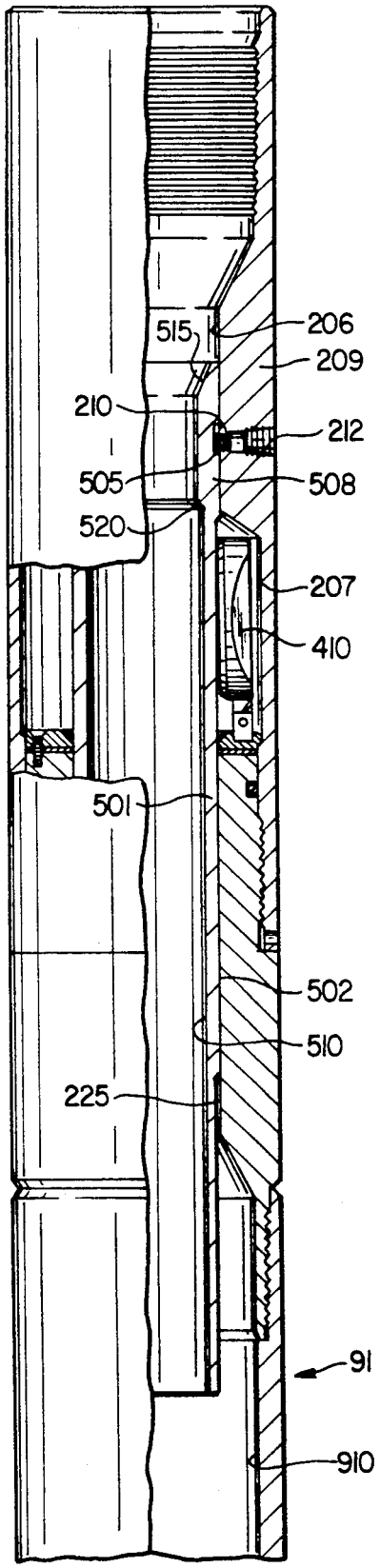
FIG. 10 A is a view partially in section and partially in elevation of the valve assembly and the upper portion of the shear sub with the protector tube in place.

In the preferred embodiment of this invention depicted in FIG. 10 A, sealing means 410 is maintained in the open position by protector tube 501 which is shearably mounted in upper housing bore 206, and passes in turn through sealing element chamber 207 and lower housing bore 225 extending below the lower end of said valve body into bore 910 of shear sub 91. The valve body and the shear sub cooperate to enclose said protector tube within the combined bores thereof during run in.

Protector tube 501 has an outer wall 502, an inner wall 510, a first opening and a second opening, said first opening and said second opening being connected by a fluid bore therebetween thus forming a fluid conduit therethrough. Said inner wall has a radially inwardly sloping shoulder 515 in close proximity to said first opening and an outwardly radially sloping "no-go" shoulder 520 located intermediate said inwardly sloping shoulder and said second opening. Said radially sloping shoulders cooperate to form pulling neck 508.

Said protector tube is maintained in position in said valve bore and said seal assembly bore by a plurality of shear screws 210 which are threadedly inserted in shear screw bores 212, said shear screw bores passing through said thickened wall 209 of upper housing 201 into threaded shear screw holes 505 which are drilled into the outer wall 502 of said protector tube.

The wash pipe which is made up to a service seal unit and gravel packer, as hereinbefore described, is located within the bore of said protector tube and is of such diameter as to pass freely through said protector tube bore. No—go locator 71 is threadedly connected to the lower end of said wash pipe.

Figure 11:
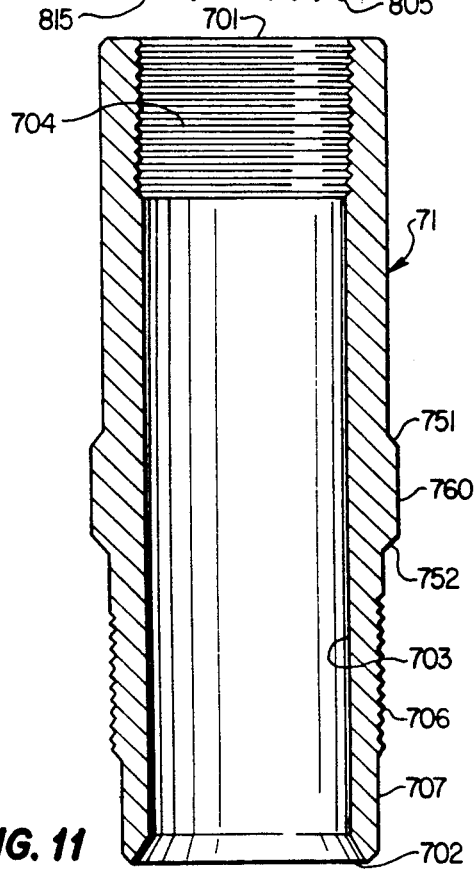
FIG. 11 is a view in cross section of the no-go locator.

Referring now to FIG. 11, no-go locator 71 is a tubular member having a first opening 701 and a second opening 702 with a fluid conduit 703 therebetween. Box thread 704 is milled into inner surface of fluid conduit 703 adjacent said first opening and pin thread 706 is milled into outer surface 707 adjacent said second opening.

Intermediate said pin thread and said box thread is top radially outwardly sloping shoulder 751 in close proximity to bottom radially inwardly sloping shoulder 752, said top shoulder cooperating with said bottom shoulder to form no-go ring 760.

In an alternative embodiment, valve 20 is not fitted with protector tube 501. Instead, wash pipe 550 is made up without no-go locator 71 and extends below packer 5 and through the flow bore of valve 20. In this configuration, said wash pipe both restrains flapper means 410 in the open position, and protects said sealing element from pitting, abrasion or other damage while the tool is being run into the well. In this configuration, the entire work string as well as the casing string, which includes said isolation valve are assembled on the surface and run in the hole as a unit.

In operation, the valve with said protector tube in place and said sealing element restrained in the open position is assembled as part of the production tubing string to be run into the hole. Then said work string is assembled within the bore of said production tubing string so that said no-go locator is positioned below said protector tube and both the production tubing and the work string are run in the hole as a unit. When the tools are at the desired depth, packer 5 is manipulated to cause camming surfaces 512, 512*a* to engage cam blocks 513, 513*a* thus forcing toothed slips 514, 514*a* into engagement with the well casing, not shown, to provide support for said work string suspended therebelow. Multiple sealing elements 517*a*, 517*b*, 517*c* are then expanded into sealing engagement with said well casing.

When the gravel pack operation is complete, the work string together with the no-go locator is pulled from the hole. No—go locator 71 travels freely upwardly within bore 510 of protector tube 501 until top shoulder 751 of locator ring 760 engages no-go shoulder 520 of pulling neck 508. Continued upward tension shears screws 210 and allows protector tube 501 to be pulled from the hole with the work string. When the bottom of said protector tube clears the upper edge of flapper means 410, said sealing element rotates into sealing engagement with valve seat 301 thus preserving completion fluids which drain from said work string for later recovery. Of course, it is readily apparent that if said no-go locator is not incorporated into the work string, such as a component of said wash pipe, and said protector tube is in the alternative embodiment hereinbefore described said sealing element will be maintained in the open position by said wash pipe until it clears said sealing element.

As the work string is pulled from the well, raised finger portions 651, 651*a* of shifting collet 65 engage detent 641 to shift sleeve 62 into the closed position. Continued upward motion of the work string pulls shifting collet 65 from sleeve 62.

After said completion fluids have been recovered from the tubing string bore by conventional recovery means, production tubing including a production seal assembly is then installed in the well and connected to the packer. Said production tubing may then be pressure tested for leakage.

After the pressure testing of the production tubing string is complete, a tooth-faced blind box hammer 801, described below, is lowered into the well bore on a wireline until it comes into contact with closed sealing means 410. The blind box hammer is then raised and allowed to strike said sealing means under the force of gravity. The teeth of the blind box hammer cause the frangible sealing means including the hinge portion there to shatter into pieces small enough to be washed out of the well bore with completion fluid or the like. Once said sealing means is shattered, the well is in condition to begin production.

One skilled in the art will readily recognize that any striking means, such as a drop bar, a dart, the mule show guide on the bottom of a Production Seal Unit, or the like, will function to shatter said frangible sealing means.

Tooth-faced blind box hammer 801 is a striking tool of generally cylindrical shape having pin connector 802 at one end and a toothed striking face 805 at the other end thereof. The diameter of said blind box hammer is slightly less than that of valve bore 225 so that said blind box hammer can freely pass therethrough. In addition to said pin connector, intermediate said pin connector and said striking face said blind box hammer may be equipped with a fishing neck F of the type commonly employed in wireline operations to retrieve tools unintentionally left in the well bore.

Figure 9:
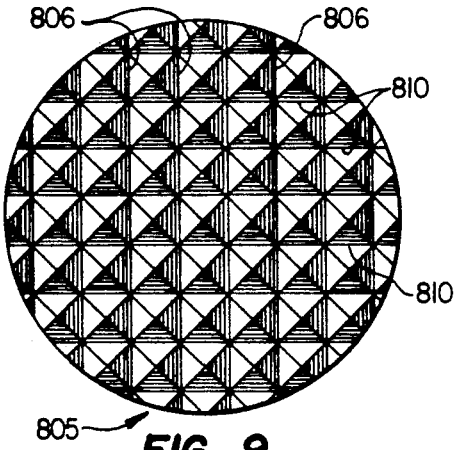
FIG. 9 is an end view of the Blind Box Hammer.
Figure 8:
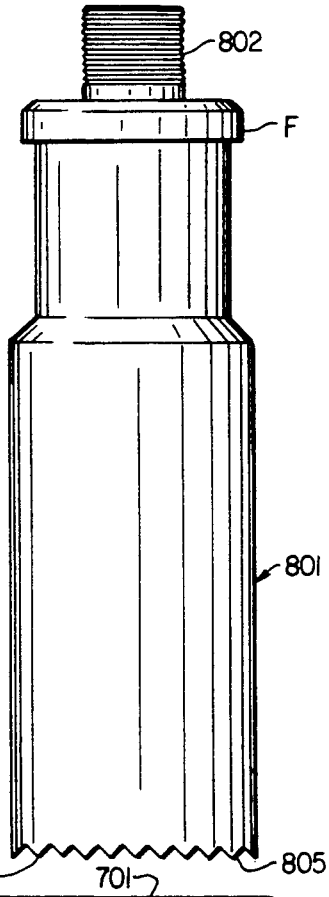
FIG. 8 is an elevational view of the Blind Box Hammer.

As shown in FIG. 9, striking face 805 has a first plurality of parallel grooves 806 milled in one direction thereon and a second plurality of parallel grooves 810 milled into said striking face at an angle to said first plurality of grooves thus forming a plurality of teeth 815 on the surface of said striking face.

In both the principal embodiment and the alternative embodiment described above, should it be desired to retrieve said valve from the hole, upward tension exerted on the production tubing after release of the packer will cause shearable means 121 which is a component of shear sub 12 to separate thus allowing the retrieval of the valve from the hole while permitting those tools and components located below said valve in the production string to remain down hole.

Although this invention has been described with reference to an exemplary embodiment and an alternative embodiment, the foregoing description is not intended to be construed in a limiting sense. Various modifications of the disclosed embodiment as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. A retrievable expendible isolation valve comprising, in combination:

an upper housing having an upper box connector and a fluid bore therethrough threadedly and sealingly connected to a lower housing having a lower pin connector and a fluid bore therethrough, said fluid bores being in flow registration with each other, said upper housing being secured against rotation with reference to said lower housing, said upper fluid bore having a reduced diameter forming a thickened upper housing wall intermediate said box connector and a radially outwardly sloping shoulder, said radially outwardly sloping shoulder increasing said diameter of said fluid bore to form a sealing element chamber therein, said lower housing having a upper shoulder upon which is fixedly and sealingly mounted an extrusion resistant valve seat assembly in flow registration with the bore thereof and a hinge bracket means mounted thereon, an extrusion resistant valve seat comprising a resilient seal member landed in a support groove formed in the annulus of said valve seat and supported by a shoulder formed in said resilient seal means in cooperation with a shoulder formed by one wall of said support groove, a machinable, frangible flapper means having integrally molded frangible hinge means, said element being rotatably attached to said hinge bracket means by a hinge pin which passes through a bore in said hinge means, said sealing element being rotatable between an open position and a closed position and being biased to said closed position by a spring wound around said hinge means and said hinge pin means, a protector tube mounted within said fluid bores of said housings by shearable means, said protector tube having a fluid bore therethrough, a pulling neck at one end thereof and a no-go shoulder formed within said fluid bore, said protector tube restraining said machinable, frangible sealing element in the open position and protecting said sealing element from cuts, abrasions or destruction during run in, and a work string comprising in part a no-go locator mounted below said no-go shoulder in said protector tube.

2. The isolation valve of claim 1 having a machinable frangible flapper means comprising a radially inwardly sloping sealing surface on its lower side and two diametrically opposed radially upwardly sloping shoulders on its upper side forming a thickened center section.

3. The frangible flapper means of claim 2 having integrally molded frangible hinge means adjacent said thickened center section.

4. The expendible isolation valve of claim 1 having said integrally molded flapper means and hinge means comprising ceramic material.

5. The expendible isolation valve of claim 1 having an extrusion resistant valve seat assembly which forms a shock absorbing means for receiving said frangible sealing means in the closed position.

6. The extrusion resistant valve seat of claim 5 comprising a support shoulder and a retaining groove formed around the annulus of said valve seat in cooperative engagement with a support shoulder and mating surfaces of a resilient seal means.

7. The resilient seal means of claim 6 comprising a reinforced polymeric material.

8. The reinforced polymeric material of claim 7 comprising a reinforced fluorocarbon material.

9. The reinforced fluorocarbon material of claim 8 comprising glass—filled teflon.

10. The resilient seal means of claim 6 comprising an elastomeric polymer.

11. The elastomeric polymer of claim 10 comprising nitrile rubber.

12. A frangible, ceramic valve flapper means comprising:

a. a radially inwardly sloping sealing surface on one side;

b. a thickened center section; and c. an integrally molded hinge means having a hinge pin bore therethrough adjacent said thickened center section.

13. The frangible ceramic flapper means of claim 12 comprising machinable material.

14. The frangible ceramic flapper means of claim 12 having a hinge pin insertable through said hinge pin bore and a closing spring wound about said hinge pin and said hinge means.

15. The frangible ceramic flapper means of claim 14 being biased to the closed position by said closing spring.

16. The frangible machinable flapper means of claim 12 cooperating with an extrusion resistant valve seat assembly in sealing engagement therewith.

17. An extrusion resistant valve seat assembly for use with a machinable, frangible flapper means comprising:

a. a cylindrical seat member with an opening therethrough and an annular retaining groove formed around said opening;

b. a resilient seal means with a mating surface to fit within said retaining groove;

c. a first support shoulder provided by a portion of said retaining groove;

d. a second support shoulder formed on a resilient seal means for engagement with said first support shoulder when said resilient seal means is disposed within said annular retaining groove; and e. a valve seating surface on said resilient seal means formed to engage said sealing element to block fluid flow through said opening.

18. The extrusion resistant valve seat assembly of claim 17 further comprising a plurality of bonds between said resilient seal means and said cylindrical seat member.

19. The extrusion resistant valve seat assembly of claim 17 wherein said resilient seal means and said cylindrical seat cooperate to form a shock absorbing means when said valve closure element engages said valve seating surface to block fluid flow through said opening.

20. The extrusion resistant valve seat assembly of claim 19 having a radially inwardly sloping sealing surface cut into one of its faces.

21. In a gravel pack system consisting of, in combination:

a. a packer having slips and seals;

b. a closing sleeve threadedly connected to said packer;

c. a retrievable, expendable isolation valve assembly having a flow bore therethrough threadedly connected to said closing sleeve;

d. a shear sub threadedly connected to said isolation valve assembly;

e. a service seal unit disposed within said closing sleeve;

f. one or more sand screens threadedly connected to each other and to said closing sleeve;

g. a seal bore sub threadedly connected to one of said sand screens;

h. a tell-tale screen threadedly connected to said seal bore sub; and i. said tell-tale screen stabbed into a sump packer wherein said retrievable, expendable isolation valve assembly contains the improvements of a machinable, frangible flapper means having integrally molded frangible hinge means rotatably mounted therein and an extrusion resistant valve seat assembly fixedly mounted in flow registration with the flow bore.

22. The gravel pack system of claim 21 wherein said isolation valve consists of, in combination, a housing with a flow bore therethrough, an extrusion resistant valve seat assembly fixedly mounted in flow registration with said flow bore and a machinable, frangible flapper means having integrally molded frangible hinge means rotatably mounted therein, said sealing element being biased to the closed position but restrained in the open position by a protector tube shearably mounted within said flow bore, said protector tube protecting said machinable, frangible flapper means from cuts, abrasions or destruction during run in.

23. The isolation valve of claim 22 in which said flapper means has an integrally molded frangible hinge means.

24. The flapper means of claim 23 comprising ceramic material.

25. The isolation valve of claim 22 having said flapper element fixedly attached within the flow bore thereof and rotatable between an open position and a closed position.

26. The gravel pack system of claim 21 having said expendible isolation valve with an extrusion resistant valve seat assembly comprising in part a resilient sealing means with an inwardly radially sloping shoulder forming shock absorbing means for receiving said frangible sealing means in the closed position.

27. The extrusion resistant valve seat assembly of claim 26 having a resilient sealing member with a support shoulder thereon in cooperative engagement with a support shoulder on said valve seat and a retaining groove in said valve seat in cooperative engagement with mating surfaces on said resilient sealing member.

28. The extrusion resistant valve seat of claim 27 wherein said radially inwardly sloping shoulder sealingly receives said frangible, machinable flapper element of claim 10 in the closed position.

29. The method of pressure testing a subterranean well and preserving well completion fluids from loss to the producing formation comprising the steps of:

a. assembling a production tubing string with a work string concentrically disposed therein;

b. running said assembled production and said work string as a unit to the desired depth in the hole;

c. manipulating a packer setting tool to set said packer in the well casing and to seal said packer to said well casing;

d. gravel packing said well by conventional means;

e. pulling said work string from within said production tubing until a no-go locator on said work string comes into contact with a no-go shoulder within the bore of a protector tube which is shearably mounted in flow registration within the flow bore of a flapper valve having a machinable, frangible sealing element;

f. applying sufficient upward force to break shear screws thereby releasing said protector tube and allowing its withdrawal from the bore of said valve;

g. removing said protector tube thereby allowing said sealing element to rotate to the closed position;

h. manipulating said work string to move a closing sleeve from an open position to a closed position;

i. allowing completion fluids to collect in said production tubing above said valve means and removing said collected completion fluids by conventional means;

j. pressure testing said tubing;

k. lowering a blind box hammer having a toothed striking face into striking engagement with said frangible sealing element thereby shattering said sealing element;

l. removing said blind box hammer from the well bore; and m. placing said well into production.

* * * * *